US005085292A

United States Patent [19]

Dial

[11] Patent Number: 5,085,292

[45] Date of Patent: Feb. 4, 1992

[54] APPARATUS FOR LUBRICATING RAILROAD VEHICLE WHEEL FLANGES

[76] Inventor: Darrel D. Dial, 11255 Highway 80 W. Suite 105, Aledo, Tex. 76008

[21] Appl. No.: 425,697

[22] Filed: Oct. 23, 1989

Related U.S. Application Data

[63] Continuation-in-part of Ser. No. 167,027, Mar. 11, 1988, Pat. No. 4,915,195.

[51] Int. Cl.[5] ..... B61K 3/00

[52] U.S. Cl. ..... 184/3.2; 184/102

[58] Field of Search ..... 184/2, 3.1, 3.2, 102; 104/279; 198/500

[56] References Cited

U.S. PATENT DOCUMENTS

| | | | |
|---|---|---|---|
| 332,994 | 12/1885 | Clarkson | 184/3.2 |
| 990,637 | 4/1911 | Dawson | 184/99 |
| 1,025,916 | 5/1912 | Kincaid | 184/3.2 |
| 1,027,559 | 5/1912 | Miner | 184/3.2 |
| 1,092,738 | 4/1914 | Miner | 184/3.2 |
| 1,152,593 | 9/1915 | Black | 184/3.2 |
| 1,279,345 | 9/1918 | Hoofer | 184/3.2 |
| 1,780,464 | 11/1930 | Coppage | 184/3.2 |
| 2,550,865 | 5/1951 | Ross et al. | 184/3.2 |
| 2,800,198 | 7/1957 | Jones | 184/3.2 |

OTHER PUBLICATIONS

General Polymeric Corporation, Poly-Pore, No date.

*Primary Examiner*—Ira S. Lazarus
*Assistant Examiner*—Alan B. Cariaso
*Attorney, Agent, or Firm*—James E. Bradley

[57] ABSTRACT

A railroad vehicle wheel flange lubricant system employs a lubricant assembly that connects to the brake shoe. The lubricant assembly has a support member that sandwiches between the brake shoe and the beam head of the braking system. An arm extends from the brake shoe in a circumferential direction. A link pivotally mounts to the outer end of the arm. A lubricant member, including a lubricant reservoir, mounts to the end of the link. A spring urges the lubricant member into contact with the flange of the vehicle wheel.

5 Claims, 2 Drawing Sheets

FIG. 2
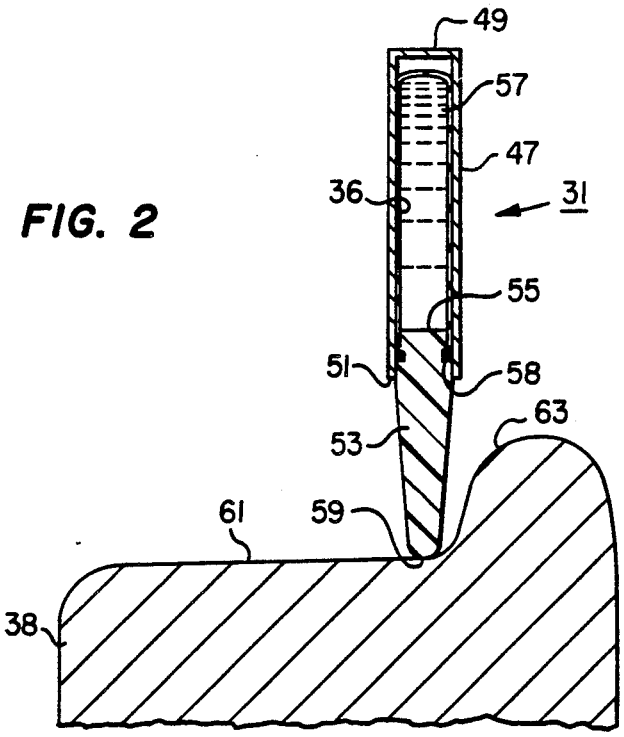
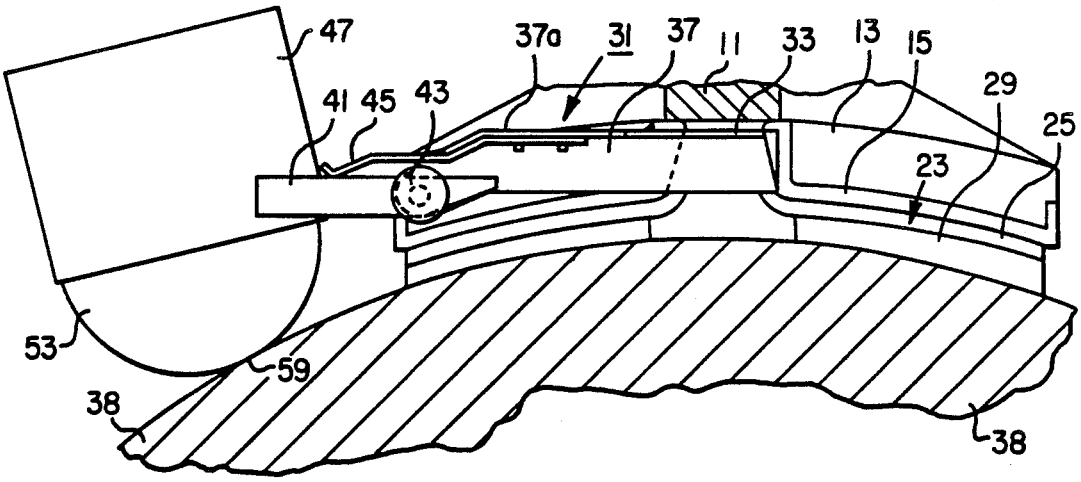
FIG. 3

APPARATUS FOR LUBRICATING RAILROAD VEHICLE WHEEL FLANGES

CROSS REFERENCE TO RELATED APPLICATIONS

This application is a continuation-in-part of application Ser. No. 167,027, filed Mar. 11, 1988, Darrell D. Dial, presently U.S. Pat. No. 4,915,195 dated Apr. 10, 1990, entitled "APPARATUS FOR LUBRICATING RAILROAD VEHICLE WHEEL FLANGES".

BACKGROUND OF THE INVENTION

1. Field of the Invention

This invention relates in general to devices for lubricating wheel flanges on railroad vehicles, and in particular to a device that employs a block of solid lubricant.

2. Description of the Prior Art

It has long been known that the friction created between the flange of a railroad vehicle wheel and the rail causes wear. A number of different lubrication systems are available on the market for applying a lubricant to the wheel flange or to the rail to reduce this wear.

All of the known systems currently available employ a liquid lubricant which is sprayed onto the wheel flange or the rail. Some are stationarily mounted beside the track at certain points. Others are mounted on board a railroad vehicle for lubricating the wheel flanges.

Generally, the on board types are fairly expensive and complex in regard to the controls for metering the spray. Because of this, normally, at most only a few of the vehicles in a train will have a lubricant system. The expectation is that the lubricant will rub from the wheel flange onto the rail and carry back to the wheel flanges of the other railroad cars in the train to apply the lubricant. The desired carry back is not always achieved.

Also, these systems have other disadvantages. They require a storage container which has to be refilled with lubricant. Some of the sprayed lubricant runs onto the rail bed and is spread by rain out into the surrounding area. This is detrimental to the environment. The systems have to be maintained.

A number of patents exist that show a solid lubricant stick which is mounted to various points on the railroad vehicle. To Applicant's knowledge, none of these systems are currently marketed. Improvements are needed to these systems.

SUMMARY OF THE INVENTION

The lubricating apparatus of this invention includes a support member which mounts to the brake shoe. An arm extends from this support member in a circumferential direction relative to the wheel. A lubricant member is mounted to this arm. The connecting means that connects the lubricant member to the arm urges the lubricant member in contact with the flange.

Preferably, this connecting means includes a link which pivotally mounts to the arm and a spring for urging the lubricant member into the flange. Also, preferably, the lubricant member includes a housing which receives a lubricant bar. The lubricant bar is a porous, solid member. Preferably, an elastomeric reservoir filled with lubricant slips over the inner end of the lubricant bar. The reservoir and inner end of the lubricant bar slide into the housing and can be replaced when depleted.

BRIEF DESCRIPTION OF THE DRAWINGS

FIG. 2 is a vertical sectional view of the lubricant system of FIG. 1.

FIG. 3 is a side elevational view of the lubricant system of FIG. 1.

DETAILED DESCRIPTION OF THE INVENTION

Figure 1:
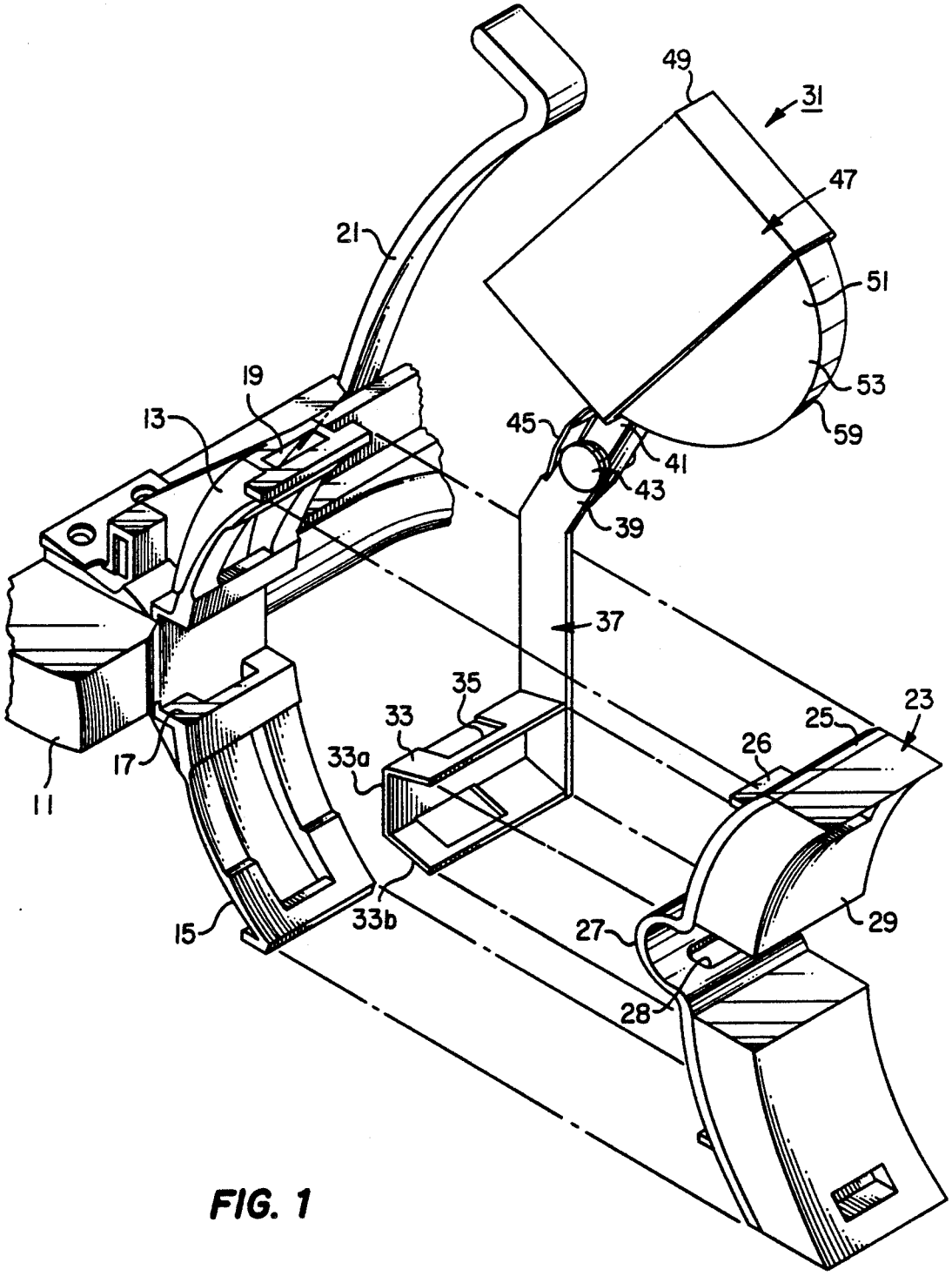
FIG. 1 is an exploded perspective view illustrating a portion of a braking system for a railroad vehicle and also including a wheel flange lubricant system constructed in accordance with this invention.

With reference to FIG. 1, a portion of a railroad vehicle brake beam 11 is shown. Brake beam 11 is a conventional type for mounting brakes to a railroad car (now shown). Brake beam 11 extends between the trucks (not shown) and has two ends (only one shown), each having a beam head 13. The beam head 13 has two curved supports 15. A transverse cavity 17 is located between supports 15. A passage 19 extends through each of the supports 15. Passages 19 are adapted to receive a key 21.

A brake shoe 23 mounts to each beam head 13. Each brake shoe 23 has a backing plate 25 that mates with the supports 15. As shown in FIG. 1, the backing plate 25 is a metal plate having lugs 26 that extend upward. Lugs 26 locate within slots in the supports 15. The backing plate 25 also has a curved locking section 27 that protrudes from the backing plate 25. The locking section 27 extends into the space between the two supports 15. The locking section 27 has two holes 28. Holes 28 align with the passages 19 for receiving the key 21.

Each brake shoe has two pads 29. Each pad 29 has a curved or arcuate face. Each pad 29 is spaced apart from the other by the length of the locking section 27. The pads 29 are of a conventional material. In conventional use, the brake shoe 23 is installed by inserting the locking section 27 into the cavity 17 between the supports 15, then inserting the key 21 through the passages 19 and holes 28 to retain the brake shoe 23.

A lubricating assembly 31 releasably mounts to the brake shoe 23 and beam head 13. Lubricant assembly 31 has a saddle or support member 33. Support member 33 is a metal member that is configured to fit over the locking section 27. It has a top **33*a* that will locate on top of the curved locking section 27. It has two sides 33*b* which incline outward in opposite directions. Each side 33*b* has a hole 35 in it. The holes 35 align with each other and align with the holes 28. The aligned holes 28, 35 will align with the passages 19 in the beam head 13 so that the key 21 can pass through the passages 19 and holes 28, 35**.

The support member 33 has an arm 37 rigidly secured along one side. The arm 37 extends from the support member 33 alongside the brake shoe 23. The arm 37 extends in a circumferential direction relative to the wheel 38, as shown in FIG. 3. Arm 37 is an angle 20 member, having a vertical side which is secured to the support member 33 and an upper side **37*a* (FIG. 3**).

Arm 37 has a free end 39 on the end opposite the connection to the support member 33. Free end 39 inclines at an angle of about 23 degrees relative to the remaining portions of arm 37. A link 41 is pivotally mounted to the arm free end 39. Link 41 extends beyond the brake shoe 23 in a circumferential direction. A pin 43 pivotally mounts the link 41 to the free end 39. This allows the link 41 to pivot or rotate about the axis of the pin 43. The axis of pin 43 will be parallel to the axis of rotation of the wheel 38.

A spring means, shown in the preferred embodiment to be leaf spring 45, pushes downward on the end of link 41 opposite the pin 43. As shown in FIG. 3, leaf spring 45 has one end connected to the upper side 37*a* of arm 37 and the other end bearing against the top of the link 41. Leaf spring 45 applies a light downward force to the link 41.

A housing 47 is rigidly secured to the link 41 on the end opposite the pin 43. Housing 47 has a closed end 49, which is shown to be the upper side in FIG. 3. Housing 47 has an open end 51 which faces downward. A solid lubricant bar 53 locates in the housing 47. Lubricant bar 53 may be of various lubricating types. Preferably, it is a porous member. One type comprises oil held in a polymer matrix, manufactured by General Polymeric Corporation of West Reading, Pa.

The lubricant bar 53 has an inner end 55 which is located within the housing 47. The inner end 55 is spaced from the closed end 49 of housing 47. An elastomeric bladder or reservoir 56 is sealingly secured to the inner end 55 by a seal 58. The reservoir 56 will be initially filled with a liquid lubricant 57. The lubricant 57 feeds into the lubricant bar 53 to maintain a supply of lubricant in the lubricant bar 53. The lubricant bar 53 and reservoir 56 can be removed from the housing 47 and replaced when the lubricant depletes or the lubricant bar 53 wears out. The lubricant bar 53 when in operation, does not move downward relative to the housing 47 as it wears, rather it remains stationary in the housing 47 until manually replaced.

The lubricant bar 53 has an arcuate tip 59 that protrudes from the open end 51 of housing 47. Tip 59 faces the tread 61 of the vehicle wheel 38. Tip 59 is positioned to engage the flange 63 at the root or junction of the flange 63 with the tread 61. The flange 63 will be on one side only of the tread 61 and protrudes radially outward.

In operation, the lubricant assembly 31 will be installed by removing the brake shoe 23. The operator removes the key 21 from the passages 19, and withdraws the brake shoe 23. He then places the support member 33 into the cavity 17 between the two backing supports 15. He will align the holes 35 with the passages 19. He then places the brake shoe locking section 27 into the support member 33. He will align the holes 28 with the holes 35. He then inserts the key 21 through the passages 19, and holes 28, 35. This sandwiches the lubricant assembly 31 with the braking assembly.

The spring 45 will push the tip 59 of the lubricant bar 53 lightly against the flange 63, as shown in FIG. 2. As the rail vehicle moves, the tip 59 will distribute a lubricant film on the flange 63. This reduces wear on the flange 63. Lubricant from the reservoir 56 will feed into the porous lubricant bar 53 to maintain the lubricant bar 53 lubricated.

Lubricant bar 53 will wear on its tip 59 over a period of time. Preferably, the capacity of the reservoir 56 and the dimensions of the lubricant bar 53 are sufficient so that the lubricant bar 53 does not need to be replaced until the brake shoe 23 needs to be replaced. When the brake shoe 23 is again replaced, only the lubricant bar 53 and the reservoir 56 need to be replaced.

The invention has significant advantages. The lubricant assembly easily secures to the brake shoe. No modifications are necessary to the vehicle braking system. The arm and biased link allow the use of a fairly large lubricant member to be utilized to provide an extensive life.

While the invention has been shown in only one of its forms, it should be apparent to those skilled in the art that it is not so limited, but is susceptible to various changes without departing from the scope of the invention.

I claim:

1. In a railroad vehicle having a plurality of wheels, each wheel having a cylindrical tread and a flange, the vehicle having a braking system with a brake beam having on each end a beam head to which is mounted a brake shoe, each brake shoe having a pad for contact with the tread, an improved apparatus for applying a lubricant to the flange, comprising in combination:

a support member;

means for sandwiching the support member between the brake shoe and beam head;

an arm joined to the support member and extending from the support member in a circumferential direction relative to the wheel;

a lubricant member; and connecting means for connecting the lubricant member to the arm and for urging the lubricant member into contact with the flange.

2. The apparatus according to claim 1 wherein the connecting means comprises:

a link having a first end pivotally connected to the arm and a second end connected to the lubricant member; and spring means mounted between the arm and link for urging the lubricant member toward the flange.

3. The apparatus according to claim 1 wherein the lubricant member comprises:

a housing which is connected to the connecting means, the housing having an open end facing the tread of the wheel;

a porous, solid lubricant bar mounted in the housing, having an outer end protruding from the open end of the housing into contact with the flange;

a reservoir in the housing; and liquid lubricant located in the reservoir in contact with the lubricant bar.

4. In a railroad vehicle having a plurality of wheels each wheel having a cylindrical tread and a flange, the vehicle having a braking system with a brake beam having on each end a beam head having an arcuate support containing a central cavity, a pair of aligned passages extending through the beam head perpendicular to the brake beam and intersecting the cavity, a brake shoe having a backing plate containing a central transverse locking section for reception in the cavity, a pair of aligned holes extending through the locking section for alignment with the passages, and a key inserted through the holes and passages to retain the brake shoe on the brake beam, an improved apparatus for applying a lubricant to the flange, comprising in combination:

a support member disposed in the cavity between the beam head and the locking section, the support member having a pair of aligned apertures which align with the holes in the locking section and the passages, the key passing through the passages, the holes and the apertures to sandwich the support member between the beam head and the brake shoe;

an arm joined to the support member and extending from the support member in a circumferential direction relative to the wheel;

a link having a first end pivotally connected to the arm and a second end extending in a circumferential direction relative to the wheel;

a lubricant member;

connecting means for connecting the lubricant member to the link; and spring means mounted between the arm and link for urging the lubricant member into contact with the flange.

5. The apparatus according to claim 4 wherein the lubricant member comprises:

a housing which is connected to the link, the housing having an open end facing the tread of the wheel;

a porous, solid lubricant bar mounted in the housing, having an outer end protruding from the open end of the housing into contact with the flange;

a reservoir in the housing; and liquid lubricant located in the reservoir in contact with the lubricant bar.

* * * * *